US006634382B1

(12) United States Patent
Boecking

(10) Patent No.: US 6,634,382 B1
(45) Date of Patent: Oct. 21, 2003

(54) HYDRAULIC CONTROL DEVICE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/049,939

(22) PCT Filed: Aug. 10, 2000

(86) PCT No.: PCT/DE00/02677

§ 371 (c)(1),
(2), (4) Date: Jun. 11, 2002

(87) PCT Pub. No.: WO01/14730

PCT Pub. Date: Mar. 1, 2001

(30) Foreign Application Priority Data

Aug. 20, 1999 (DE) ..... 199 39 457

(51) Int. Cl.[7] ..... F02M 59/36; F02M 59/46

(52) U.S. Cl. ..... 137/627.5; 137/630; 137/630.14; 123/446

(58) Field of Search ..... 137/627.5, 630, 137/630.14, 630.15; 251/129.01, 129.06; 123/446, 457; 417/278

(56) References Cited

U.S. PATENT DOCUMENTS 6,199,533 B1 * 3/2001 Morris et al. ..... 123/299
6,283,154 B1 * 9/2001 Rizk et al. ..... 137/625.65
6,364,282 B1 * 4/2002 Ausman et al. ..... 251/129.16

FOREIGN PATENT DOCUMENTS

DE 38 44 133 A1 * 7/1989
EP 0 367 114 A2 * 5/1990
EP 0 622 573 A1 * 11/1994
WO WO 99/09318 * 2/1989

OTHER PUBLICATIONS

International search Report for the correspnding PCT Application PCT/DE 00/02677; Dec. 2000.*
International Preliminary Examination Report for th ecorresponding PCT Application PCT/DE 00/02677; Jul. 2001.*

* cited by examiner

*Primary Examiner*—Michael Powell Buiz
*Assistant Examiner*—Ramesh Krishnamurthy
(74) *Attorney, Agent, or Firm*—Ronald E. Greigg

(57) ABSTRACT

A hydraulic control device for an apparatus for injecting fuel into a combustion chamber of an internal combustion engine has an externally controllable actuation device and a valve part, which cooperates with this actuation device. In order to determine the injection parameters, this valve part controls pressure fluid connections between at least one high pressure-carrying conduit and a low pressure-carrying conduit. The valve part has at least two valve seats in order to produce a multi-stage injection event. These are controlled by separate valve members, which are guided so that they can move in relation to each other and can be actuated in the same direction. Multi-stage injection events can consequently be produced by means of a single triggering of the actuation device. This reduces the triggering frequency and therefore reduces the heat generation of the actuation device.

20 Claims, 3 Drawing Sheets

HYDRAULIC CONTROL DEVICE

CROSS-REFERENCE TO RELATED APPLICATIONS

This application is a 35 U.S.C. 371 application of PCT/DE 00/02677, filed on Aug. 10, 2000.

BACKGROUND OF THE INVENTION

1. Field of the Invention

The invention is based on hydraulic control devices for controlling injection of fuel into internal combustion engines.

2. Description of the Prior Art

DE 38 44 133 A1 has disclosed a metering injection valve for an internal combustion engine that is equipped with a hydraulic control device of the type with which this invention is concerned. This control device has an actuation device, which acts on the valve body of a valve part in order to control the parameters of the injection process, for example the injection onset or the injection-duration.

In order to permit a clean-burning and fuel-saving operation of an internal combustion engine, it can be advantageous to divide the injection process into a number of injection phases that follow one another in chronological sequence. The rapid switching events required for this can be achieved, in particular, by using piezoelectric actuators as actuation devices. However, it is disadvantageous that these piezoelectric actuators produce a relatively large amount of heat loss, which increases as the frequency of the triggering pulses rises. Under extreme operating conditions, this can lead to thermally-induced failures of the actuation devices.

SUMMARY OF THE INVENTION

The hydraulic control device that forms the basis of the invention has the advantage over the prior art that a single triggering of the actuation device can achieve an injection process that is divided into several injection phases. The frequency of the triggering of the actuation device and therefore the generated waste heat of the actuator is thus reduced and the operational reliability is therefore increased.

BRIEF DESCRIPTION OF THE DRAWINGS

An exemplary embodiment of the invention is explained in detail herein below, with reference to the drawings, in which.

DESCRIPTION OF THE PREFERRED EMBODIMENTS

Figure 1:
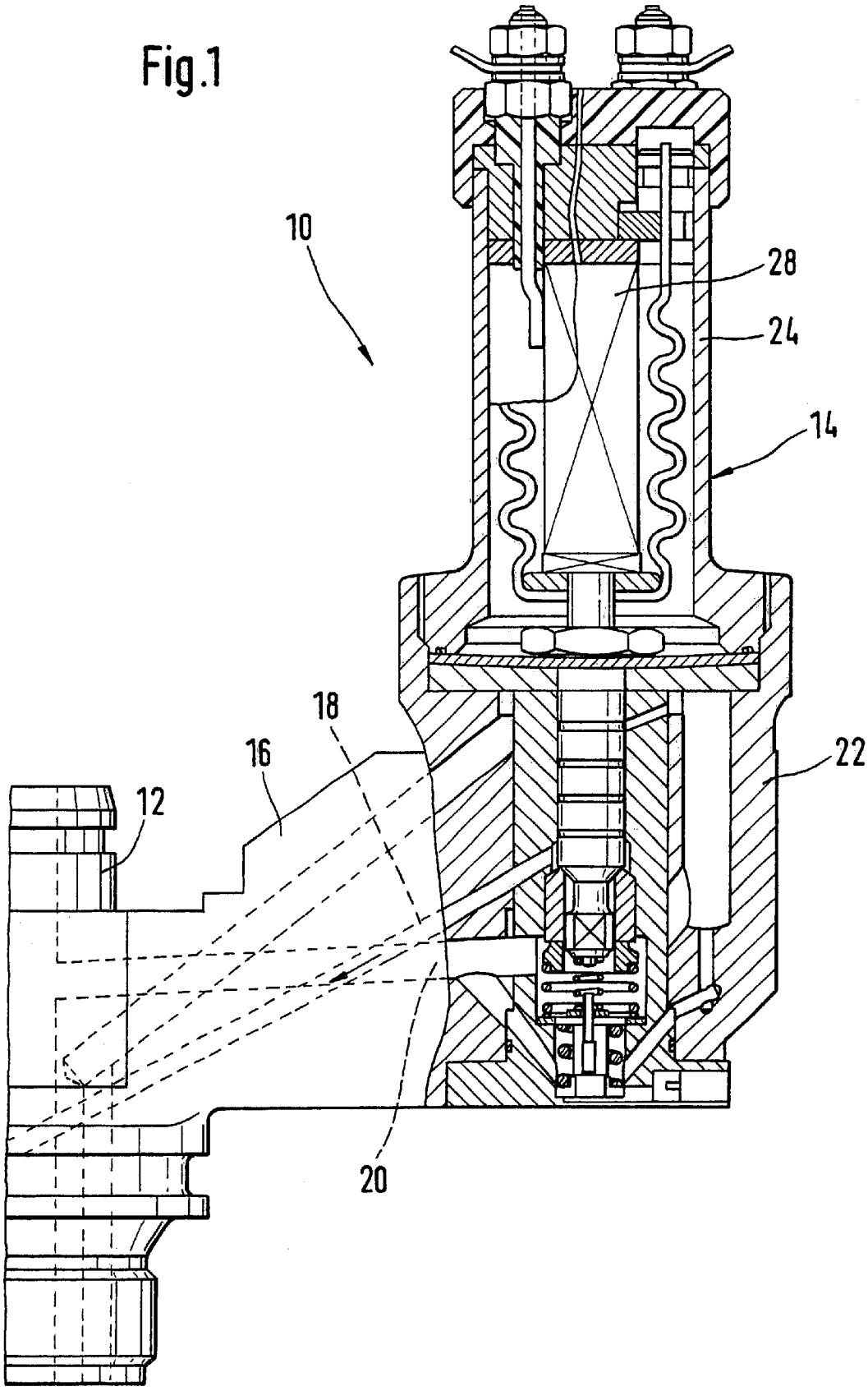
FIG. 1 shows a cross section through the control device when mounted to the pressure generator.

In FIG. 1, the reference number 10 indicates a pump/nozzle injection system for producing a fuel/air mixture in a combustion chamber of an internal combustion engine. To generate the injection pressure, this injection system 10 has a pump, of which only the pump body 12 is shown in FIG.

1. The pump is actuated by a cam shaft, which is driven by the internal combustion engine and is not shown in FIG. 1. The pump is connected to an injector that is also not shown. This injector injects fuel into the combustion chamber of the internal combustion engine as soon as a predetermined opening pressure in the fuel is exceeded. At the same time as the injection event, the injector prepares the fuel/air mixture for a favorable ignition and optimal combustion. The parameters of the injection event, i.e. essentially the injection onset and injection duration, are adapted by a hydraulic control device 14 to the current operating conditions of the internal combustion engine by virtue of the fact that this control device 14 regulates the pressure level in the fuel.

The control device 14 is installed in a fitting 16, which is formed onto the side of the pump body 12 and which contains fuel-carrying conduits 18, 20. In order to generate an injection pressure in the injector, the control device 14 closes a pressure fluid connection between the conduit 18, which conveys high-pressure fuel and acts as an inlet to the control device 14, and the pressure-relieved conduit 20, which constitutes the return of the control device 14. In the same way, this pressure fluid connection is opened as soon as a desired injection pressure is achieved or the injection event is to be ended.

In order to fulfill this purpose, the control device 14 is comprised of a valve part 22 and an actuation device 24 that cooperates with it. The latter can, for example, have a piezoelectric actuator 28.

Figure 2:
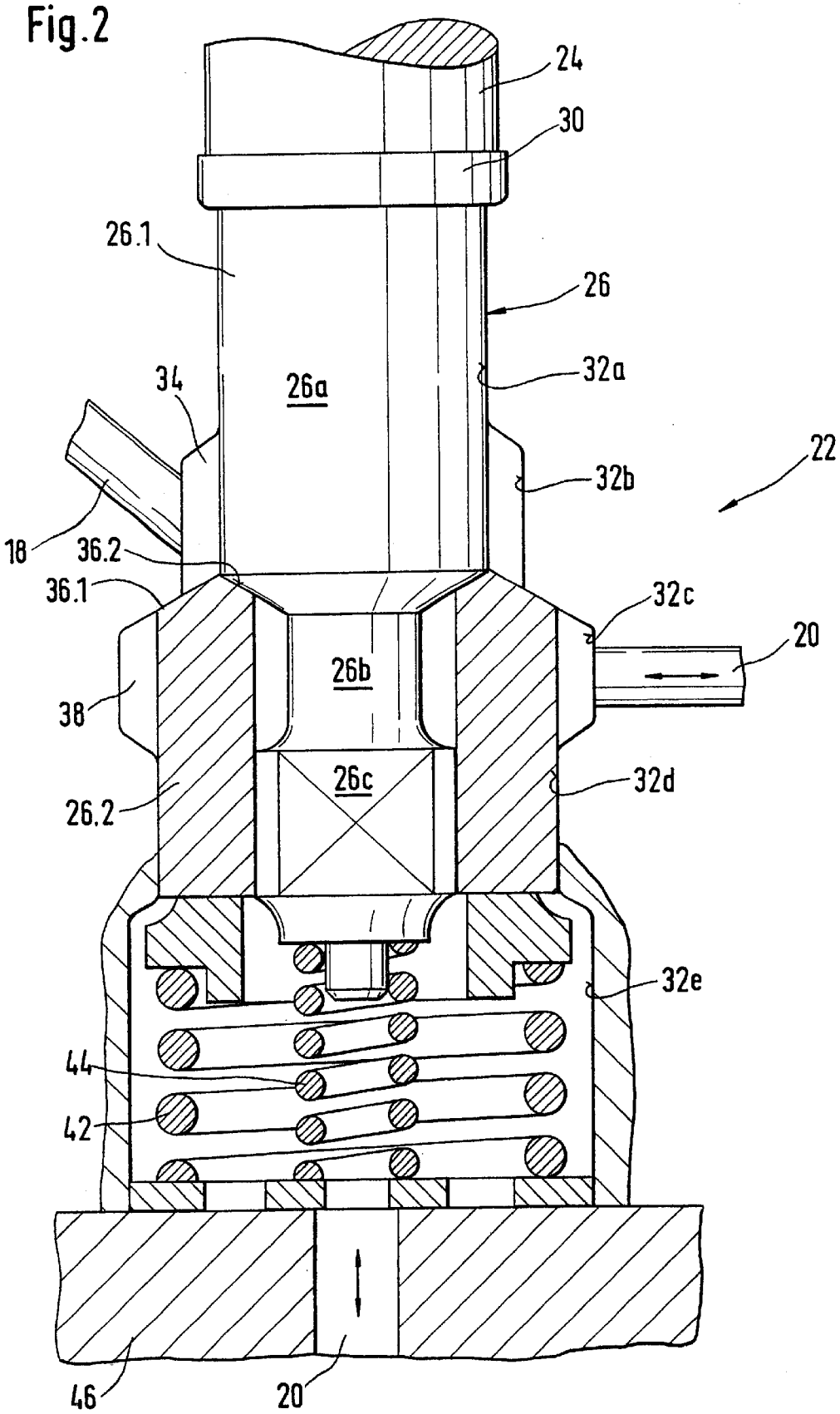
FIG. 2 shows an enlarged cross-sectional view of a portion of the structure shown in FIG. 1.

In particular, piezoelectric actuators are distinguished by their small dimensions and their high switching speeds, but generate relatively high heat losses depending on the triggering frequency. The invention is based on a special embodiment of the valve part 22, which counteracts this heat generation. The valve part 22 according to the invention is shown in an enlarged detail in FIG. 2 and will be explained below.

The valve part 22 has a valve bore 32, which is comprised of bore sections 32*a, b, c, d*, and *e* of differently sized inner diameters. The first bore section 32*a* oriented toward the actuation device 24 has the smallest inner diameter and its wall serves as a guide for a first valve member 26.1 of the valve body 26. This bore section 32*a* transitions into a bore section 32*b* of a larger inner diameter. Between the first valve member 26.1 and the bore section 32*b*, there is a first annular conduit 34, into which the conduit 18 feeds, which comes from the pump and conveys highly pressurized fuel. A third bore section 32*c* of even greater inner diameter adjoins the-bore section 32*b*. The transition from the bore section 32*b* to 32*c* is embodied as a bevel, which constitutes a first valve seat 36.1. This first valve seat 36.1 is controlled by a sleeve-shaped second valve member 26.2, which is guided on the circumference side in the fourth bore section 32*d*. The diameter of this fourth bore section 32*d* lies dimensionally between that of the bore sections 32*b* and 32*c* so that between the second valve member 26.2 and the wall of the bore sections 32*c*, a second annular conduit 38 is produced. The conduit 20 feeds into this second annular conduit 38. For production engineering reasons, a fifth bore section 32*e* has the same inner diameter as the bore section 32*c*.

As indicated above, the valve part 22 has two valve members 26.1 and 26.2, which can be moved in relation to each other and in the same direction, which jointly constitute the valve body 26. The first valve member 26.1 has a cylindrical shaft 26*a*, which is connected by means of a constriction 26*b* to a head 26*c*, which has a smaller outer diameter than this shaft 26*a*. The constriction 26*b* and the head 26*c* protrude into the interior of the sleeve-shaped second valve member 26.2, where the head 26*c* serves to guide and center the first valve member 26.1 in the second valve member 26.2. The head 26*c* is provided with flattenings, which connect the inside of the second valve member 26.2 to the bore section 32*e*. The transition from the shaft 26*a* to the constriction 26*b* is embodied as a bevel. This bevel cooperates with an opposing bevel embodied on the inside of the second valve member 26.2, which constitutes a second valve seat 36.2.

On the circumference of the second valve member 26.2, a second bevel is provided, which is oriented in the opposite direction from the first bevel. This second bevel controls the first bevel 36.1. The ends of the two valve members 26.1 and 26.2 oriented away from the valve seats 36.1 and 36.2 serve as first supports for two restoring springs 42 and 44 disposed concentrically to each other. A second support is constituted by a closing plate 46 of the valve bore 32. A low pressure-carrying conduit 20 is disposed in this closing plate 46, which pressure relieves the bore section 32*e* and the hollow space between the constriction 26*b* and the inner wall of the second valve member 26.2.

In order to transfer and simultaneously hydraulically translate a switching motion of the actuation device 24 to the valve body 26, a pressure chamber 30 with differently sized pressure surfaces is disposed between these two components. The smaller pressure surface is constituted by the end of the shaft 26*a* of the valve body 26.

In contrast to the depiction in FIG. 1, when the actuation device 24 is not actuated, the first valve member 26.1 is disposed in a position in which the second valve seat 36.2 is open and the first valve seat 36.1 is closed, as shown. This starting position is predetermined by the restoring springs 42 and 44. The flattenings embodied in the head 26*c* of the first valve member 26.1 produce a hydraulic connection between the high pressure-carrying conduit 18 and the low pressure-carrying conduit 20 in the closing plate 46. This pressure fluid connection prevents a pressure buildup in the injector and therefore prevents an injection event from occurring.

In a first stage of the actuation, the actuation device 24 (FIG. 1) is supplied with current in such a way that the valve member 26.1 closes the second valve seat 36.2, but without thereby opening the first valve seat 36.1. The pressure fluid connection between the conduits 18 and 20 is closed in such a way that a pressure buildup produced by the pump can occur in the injector. When the predetermined opening pressure is achieved, the injector injects fuel into the combustion chamber of an internal combustion engine.

In order to end this first injection event, the actuation device 24 is supplied with more power in a second switching stage. The correspondingly greater adjusting motion of the actuation device 24 causes the second valve member 26.2 to lift up from the first valve seat 36.1 while the second valve seat 36.2 remains closed by the first valve member 26.1 as before. The hydraulic coupling thus produced between the annular conduits 34 and 38 and the conduits 18 and 20 achieves a pressure relief of the injector. The first injection event is thus terminated.

For a second injection event, the second stage of the power supply to the actuation device 24 is withdrawn, as a result of which the pressure fluid connection between the conduits 18 and 20 is closed again. As a result, a pressure buildup can occur in the injector. A further withdrawal of the power supply of the actuation device 24 back to zero reinstates the pressure fluid connection and thus also terminates the second injection event.

A single stroke motion of the actuation device 24 occurring in stages thus permits two injection events in chronological sequence to be controlled separately from each other. In comparison to the prior art cited, this halves the triggering frequency of the actuation device 24 and therefore halves its heat losses generated as a function of the triggering frequency.

Figure 3:
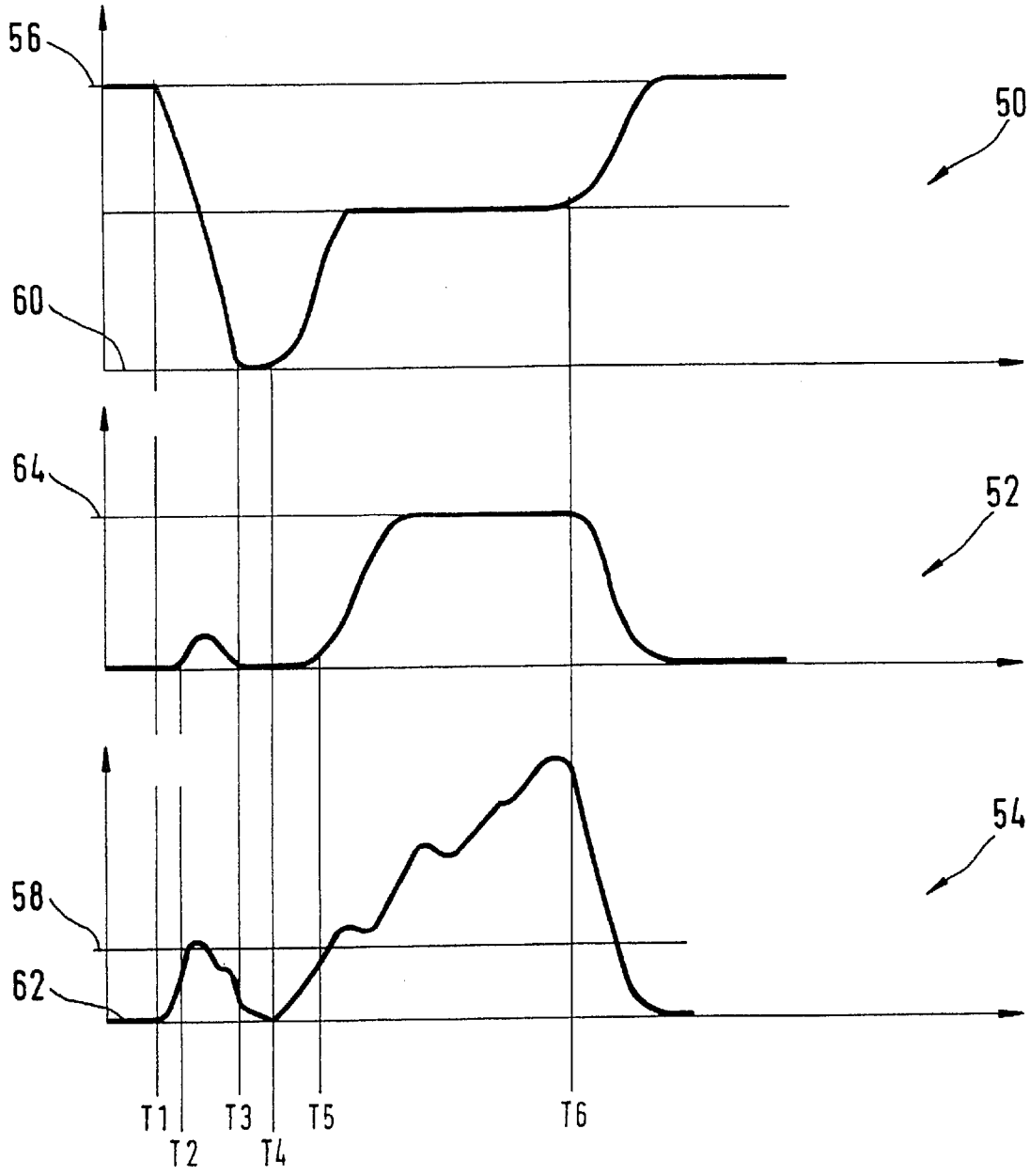
FIG. 3 shows three graphs to illustrate the way the invention functions, in which the adjusting motion of the actuation device, the opening motion of a closing member of the injector, and the pressure in the injector are plotted so as to be chronologically synchronized with one another.

FIG. 3 shows three graphs 50, 52, 54 that demonstrate how the valve part 22 embodied according to the invention functions. The graph 50 shows the stroke of the actuation device 24, graph 52 shows the opening motion of a closing member built into the injector, and graph 56 shows the pressure of the pressure fluid in the injector, and all the graphs are plotted so as to be chronologically synchronized with each other.

The characteristic curves shown begin at a time T1 in which the first valve seat 36.1 is open and the second valve seat 36.2 is closed by the first valve member 26.1, i.e. at the time of the maximal stroke 56 of the actuation device 24. With the withdrawal of the power supply to the actuation device 24, the initially open first valve seat 36.1 is successively closed by the second valve member 26.2 and therefore the existing pressure fluid connection between the conduits 18 and 20 is closed. As a result, the pressure in the injector gradually increases (graph 54). After the predetermined opening pressure 58 is exceeded at time T2, the closing member in the injector executes an opening motion that is visible in the graph 52 so that fuel can travel into the combustion chamber of the associated cylinder.

With a continued withdrawal of the power supply to the actuation device 24, its stroke goes back to the minimal value 60 at time T3, as a result of which the first valve member 26.1 then unblocks the second valve seat 36.2. This reinstates a pressure fluid connection between the conduits 18 and 20 so that the pressure in the injector (graph 54) falls to the minimal pressure 62.

First, a renewed supply of power to the actuation device 24 leads once more to a closing of the pressure fluid connection between the conduits 18 and 20 and thus to a pressure increase in the injector (time T4). This leads, in a time-delayed fashion, at time T5 to an opening motion as soon as the predetermined opening pressure 58 has been exceeded. The opening motion assumes its maximal value 64 as soon as the opening pressure has been exceeded and remains until the inertia of the closing element of the injector has been overcome.

The course of pressure above the opening pressure in this case has no significant bearing on the opening motion of the closing member.

According to graph 52, the power supply to the actuation device 24 is first increased after a time delay (time T6) During this delay, the injector is maximally open and continuously injects fuel into the combustion chamber of the associated cylinder. When the power supply to the actuation device 24 is increased, its stroke increases again to the maximal value 56. Thus the second valve member 26.2 opens the first valve seat 36.1 and produces a connection between the conduits 18 and 20 so that the pressure in the injector drops to the minimal value 62.

Two chronologically separate injection events consequently occur during an actuation cycle, i.e. during a triggering of the actuation device 24.

Naturally advantages or advantageous modifications of the invention are possible without going beyond the scope of the concept of the invention.

What is claimed is:

1. A hydraulic control device (14), in particular for an apparatus for injecting fuel into a combustion chamber of an internal combustion engine, comprising an externally controllable actuation device (24), a valve part (22), which cooperates with the actuation device (24), the valve part (22) having at least two valve seats (36.1 and 36.2), which each constitute a pressure fluid connection between a high pressure-carrying conduit (18) and a low pressure-carrying conduit (20), and a valve body (26) supported so that it can move in the valve part (22), the valve body (26) including at least two closing members (26.1 and 26.2), which can be actuated in the same direction in order to close the one valve seat (36.1, 36.2) and open the respective other valve seat (36.1, 36.2) in a comparatively time-delayed fashion.

2. The hydraulic control device according to claim 1 wherein the closing members (26.1, 26.2) are disposed coaxial to each other and protrude at least partially into each other for reciprocal centering purposes.

3. The hydraulic control device according to claim 1 wherein each closing member (26.1, 26.2) is associated with at least one restoring device (42, 44).

4. The hydraulic control device according to claim 2 wherein each closing member (26.1, 26.2) is associated with at least one restoring device (42, 44).

5. The hydraulic control device according to claim 1 wherein at least one of the respective valve seats (36.1 and 36.2) is embodied on the valve part (22) and at least one is embodied on one of the closing members (26.1 and 26.2).

6. The hydraulic control device according to claim 4 wherein at least one of the respective valve seats (36.1 and 36.2) is embodied on the valve part (22) and at least one is embodied on one of the closing members (26.1 and 26.2).

7. The hydraulic control device according to claim 1 wherein the valve seats (36.1 and 36.2) are disposed spaced radially apart from each other in a common plane.

8. The hydraulic control device according to claim 4 wherein the valve seats (36.1 and 36.2) are disposed spaced radially apart from each other in a common plane.

9. The hydraulic control device according to claim 5 wherein the valve seats (36.1 and 36.2) are disposed spaced radially apart from each other in a common plane.

10. The hydraulic control device according to claim 1 wherein the transfer of the adjusting motion from the actuation device (24) to the valve body (26) takes place through the interposition of a pressure chamber (30) with differently sized pressure surfaces.

11. The hydraulic control device according to claim 2 wherein the transfer of the adjusting motion from the actuation device (24) to the valve body (26) takes place through the interposition of a pressure chamber (30) with differently sized pressure surfaces.

12. The hydraulic control device according to claim 3 wherein the transfer of the adjusting motion from the actuation device (24) to the valve body (26) takes place through the interposition of a pressure chamber (30) with differently sized pressure surfaces.

13. The hydraulic control device according to claim 5 wherein the transfer of the adjusting motion from the actuation device (24) to the valve body (26) takes place through the interposition of a pressure chamber (30) with differently sized pressure surfaces.

14. The hydraulic control device according to claim 7 wherein the transfer of the adjusting motion from the actuation device (24) to the valve body (26) takes place through the interposition of a pressure chamber (30) with differently sized pressure surfaces.

15. The hydraulic control device according to claim 1 wherein the actuation device (24) can be electrically triggered and has a piezoelectric actuator (28) for converting the control signal in to an actuating motion.

16. The hydraulic control device according to claim 2 wherein the actuation device (24) can be electrically triggered and has a piezoelectric actuator (28) for converting the control signal in to an actuating motion.

17. The hydraulic control device according to claim 3 wherein the actuation device (24) can be electrically triggered and has a piezoelectric actuator (28) for converting the control signal in to an actuating motion.

18. The hydraulic control device according to claim 5 wherein the actuation device (24) can be electrically triggered and has a piezoelectric actuator (28) for converting the control signal in to an actuating motion.

19. The hydraulic control device according to claim 7 wherein the actuation device (24) can be electrically triggered and has a piezoelectric actuator (28) for converting the control signal in to an actuating motion.

20. The hydraulic control device according to claim 10 wherein the actuation device (24) can be electrically triggered and has a piezoelectric actuator (28) for converting the control signal in to an actuating motion.

* * * * *